US008152009B2

(12) United States Patent
Hulin

(10) Patent No.: US 8,152,009 B2
(45) Date of Patent: Apr. 10, 2012

(54) BOTTLE CAP PROTECTOR

(75) Inventor: Paul Hulin, Quainton (GB)

(73) Assignee: Premier Security Products Limited (GB)

( * ) Notice: Subject to any disclaimer, the term of this patent is extended or adjusted under 35 U.S.C. 154(b) by 789 days.

(21) Appl. No.: 11/920,959

(22) PCT Filed: May 18, 2006

(86) PCT No.: PCT/GB2006/001827

§ 371 (c)(1),
(2), (4) Date: Dec. 11, 2008

(87) PCT Pub. No.: WO2006/123152

PCT Pub. Date: Nov. 23, 2006

(65) Prior Publication Data

US 2009/0184121 A1 Jul. 23, 2009

(30) Foreign Application Priority Data

May 20, 2005 (CN) ..... 2005 2 0102309 U
Aug. 24, 2005 (CN) ..... 2005 2 0014299 U
Sep. 29, 2005 (GB) ..... 0519785.0

(51) Int. Cl.
*B65D 45/32* (2006.01)
*B65D 41/04* (2006.01)

(52) U.S. Cl. ..... 215/330; 215/218; 215/272

(58) Field of Classification Search ..... 215/330, 215/218, 219, 216, 272
See application file for complete search history.

(56) References Cited

U.S. PATENT DOCUMENTS

| | | | | |
|---|---|---|---|---|
| 200,883 | A * | 3/1878 | Weber | 215/306 |
| 3,895,731 | A * | 7/1975 | Coursaut | 215/218 |
| 4,770,307 | A * | 9/1988 | Guglielmi | 215/272 |
| 5,174,460 | A * | 12/1992 | Minnette | 215/335 |
| 5,259,618 | A * | 11/1993 | Ramos | 273/145 C |
| 5,344,035 | A * | 9/1994 | Manera | 215/219 |
| 5,957,313 | A | 9/1999 | Bouan et al. | |
| 7,259,674 | B2 * | 8/2007 | Marsilio et al. | 340/572.1 |
| 2001/0013478 | A1 * | 8/2001 | Earnhart | 206/407 |
| 2004/0026354 | A1 * | 2/2004 | Folchini et al. | 215/272 |

FOREIGN PATENT DOCUMENTS

| | | |
|---|---|---|
| FR | 2 608 285 A | 6/1988 |
| WO | WO 2004/076295 A | 9/2004 |

* cited by examiner

*Primary Examiner* — Mickey Yu
*Assistant Examiner* — Niki Eloshway
(74) *Attorney, Agent, or Firm* — Drinker Biddle & Reath LLP

(57) ABSTRACT

A device for protecting the cap of a bottle having a neck, said device comprising a cap portion adapted to be placed over the neck of the bottle and a base portion, the base portion being rotatably connected to the cap portion, at least one elongate securing member being provided having a first end attached to the cap portion and a second end attached to the base portion whereby rotation of the base portion with respect to the cap portion in a tightening direction causes the elongate securing member to tighten against the neck of the bottle to resist removal of the device from the neck of the bottle, locking means being provided for selectively preventing rotation of the base portion with respect to the cap portion at least in a second direction opposite to said tightening direction. The device may be provided with an EAS tag.

10 Claims, 2 Drawing Sheets

BOTTLE CAP PROTECTOR

The invention relates to a bottle cap protector for preventing tampering with and/or theft of bottles.

Bottled goods on the open shelves of the supermarket, such as the bottled wine, sprits or beverages, are often illegally opened or taken away. The supermarket owner often employs measures such as surveillance, attaching a bottle cap protection cover on the bottle or hanging electronic article surveillance tags or labels (hereinafter referred to as EAS tags) to deter theft and/or tampering with such bottles.

A known bottle cap protection covers such as that shown in US 2005/0144992 A1, comprises elastic claws that can be radially urged against the neck of the bottle under the force of a conical outer jacket such that the claws cooperate with a bead typically disposed on the upper end of the neck of the bottle to secure the cover onto the bottle mouth. The protection cover and the conical jacket can only be separated by a special tool.

The protector with said structure has weak connection with the bottle, thus is easily detached from the bottle after shaking, so that the protection function will be of no effect. In addition, the known protector has a short service life and limited reuse times and is difficult to fit and remove, requiring a special tool that may be lost or misplaced.

For the EAS tag, the owner of the supermarket often hangs such tags onto the bottleneck. Though the measure is simple, the EAS tag or label is subject to damage, which is detrimental to the appearance of the goods in question.

According to the present invention there is provided a device for protecting the cap of a bottle having a neck, said device comprising a cap portion adapted to be placed over the neck of the bottle and a base portion, the base portion being rotatably connected to the cap portion, at least one elongate securing member being provided having a first end attached to the cap portion and a second end attached to the base portion whereby rotation of the base portion with respect to the cap portion in a tightening direction causes the elongate securing member to tighten against the neck of the bottle to resist removal of the device from the neck of the bottle, locking means being provided for selectively preventing rotation of the base portion with respect to the cap portion at least in a second direction opposite to said tightening direction.

Preferably at the least one elongate securing member comprises a wire, cable, cord, rope of similar elongate member. The elongate member may be coated or covered by a polymeric or fabric outer sheath to prevent damage to the neck of bottle and/or packaging and/or labeling material applied thereto.

In one embodiment a single elongate securing member is provided. In an alternative embodiment a pair of elongate securing members are provided arranged to engage opposing sides of the neck of a bottle.

Preferably the locking means comprises a locking member provided on the base portion and being moveable between a first position wherein the locking member cooperates with a region of the cap portion to prevent rotation of the cap portion with respect to the base portion and a second position wherein the cap portion is free to rotate with respect to the base portion to permit removal of the device from the neck of a bottle. Biasing means may be provided for biasing the locking member towards its first position. Preferably the locking member is moveable in a radial direction.

The locking means may comprise a toothed segment provided on the cover portion and the locking member may comprise a pawl engageable with the toothed segment when the locking member is in said first position to prevent rotation between the cap portion and the base portion in at least said second direction.

Preferably the teeth of the toothed segment and the cooperating portion of the locking member are shaped to permit rotation between the cap portion and the base portion in said tightening direction but to prevent rotation in said second direction when the locking member is in its first position in the manner of a ratchet.

In an alternative embodiment, the locking member may comprise a pin receivable in a receiving aperture provided on the cap portion when the locking member is in its first position.

The locking member may be magnetically moveable from its first to its second position when acted upon by an external magnetic field.

Biasing means may be provided for biasing the cap portion and base member for relative rotation in said second direction opposite to said tightening direction to assist removal of the device from a bottle.

A skirt portion may extends from the base portion of the device to prevent tampering with the locking means when the device is fitted to a bottle.

Preferably the device includes an electronic article surveillance tag (EAS tag) to permit unauthorised removal of the bottle to which the device is fitted from a store to be detected.

Preferably at least the cap portion of the device is formed from a transparent material to permit labels or other branding on the neck of the bottle to be viewed through the cap portion.

Two embodiments of the present invention will now be described by way of example only, and with reference to the accompanying drawings in which.

Figure 1:
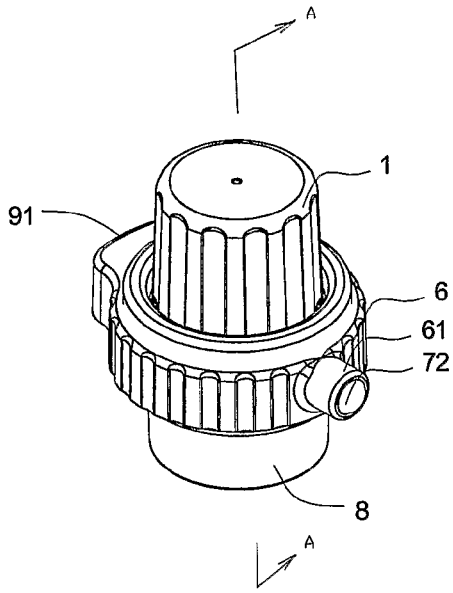
FIG. 1 is a schematic drawing of a first embodiment of the invention.

Referring to the figures, the bottle cap protector according to a first embodiment of the present invention comprises a cap portion or protection cover 1, a pair of elongate securing members or tying tapes 2 and a base portion or mounting base 3. It is also envisaged that only a single elongate securing member of tying tape might be provided.

The or each tying tape 2 comprises a steel wound cable. A plastic coating is provided on the cable to prevent damage to the neck of the bottle or to any labeling, foil or other packaging material applied thereto.

One end 21 of the or each tying tape 2 is connected to the protection cover while the other end 22 is connected with the mounting base. The protection cover is rotatable relative to the mounting base.

The bottle cap protector is also equipped with a locking mechanism or structure for selectively preventing rotation between the protection cover and the mounting base, at least other than in a first or tightening direction. The locking mechanism includes an unlocking member cooperating with an unlocking tool to permit removal of the protector from a bottle by authorised personnel.

When the protector provided by the invention covers the upper end of the bottle, the or each tying tape 2 substantially lies under a circumferential bead provided adjacent an upper end of the bottleneck. In this way, when the protection cover rotates with respect to the mounting base in the first or tightening direction, the tying tapes wind spirally on the bottle surface, and with further rotation of the protection cover, the tying tapes wind tightly around the narrowest portion of the bottle neck to secure the protector onto on the bottle.

Due to the locking mechanism preventing rotation of the protection cover with respect to the mounting base in a second direction opposite to the abovementioned first or tightening direction, the protector will remain secured on the bottle neck unless the corresponding tool is used to unlock the locking mechanism. Thus the purpose of preventing the bottle cap from being opened illegally can be realized.

Certainly, it is feasible to rotate the mounting base to wind the tying tape tightly in operation.

Figure 2:
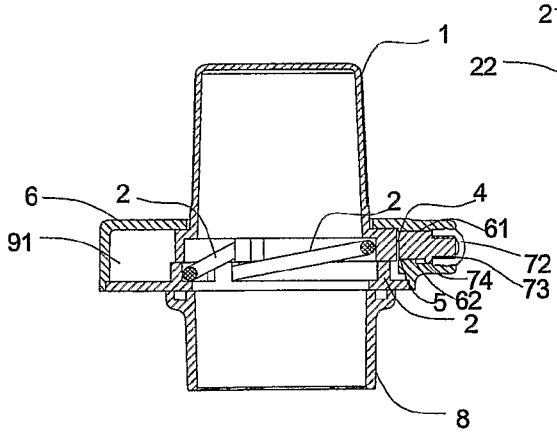
FIG. 2 is a section view of FIG. 1 along A-A.

Referring to the FIG. 2, the locking structure can employ a tooth-lock structure which comprises a tooth segment 4 unrotatable relative to the protection cover and a tooth segment 5 unrotatable relative to the mounting base, and the two tooth segments form a ratchet type unidirectional tooth-lock fit. When the two tooth segments are in the locking state, they mesh with each other, and the mesh state only allows the two tooth segments to rotate relatively along the tightening direction of winding the tying tape instead of along the second or opposite direction.

In this way, the operation of winding the tying tape is convenient, and when unlocking is needed, the two tooth segments can be released to allow the protection cover and the mounting base rotate freely, thus detaching the bottle cap protector or mounting the protector onto another bottle.

Spring biasing means may be provided to urge the protection cover and base member to rotate in an unwinding direction to assist removal of the protector from the neck of a bottle when the locking mechanism is released.

The unlocking member can be a part connecting with the lock structure, the part being formed from or containing a member capable of being attracted by a magnet, or the unlocking member may be one part of the lock structure, formed from or containing a member capable of being attracted by a magnet.

Figure 3:
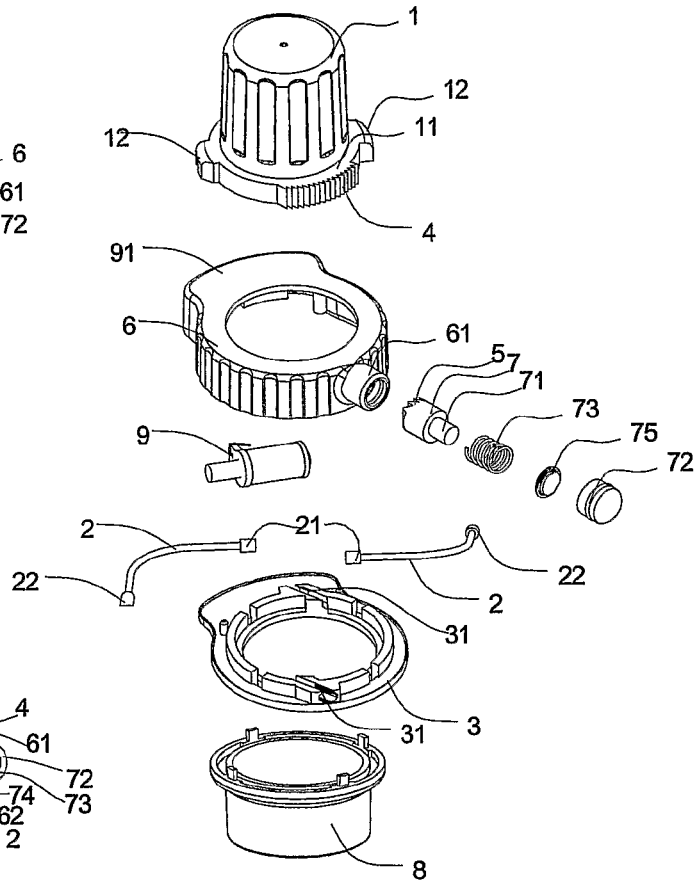
FIG. 3 is a schematic drawing of the fit between the two tooth segments in the embodiment of FIG. 1.
Figure 4:
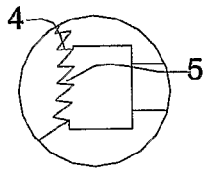
FIG. 4 is an exploded view of FIG. 1.

Referring to the FIGS. 2, 3 and 4, the tooth segment 4 on the protection cover is arranged on a lower side surface of the protection cover. The mounting base is arranged under the protection cover and is provided with a lock structure casing 6 connected therewith. The lock structure casing 6 is equipped with a guide hole 61, in which a moveable post 7 is arranged. On the position corresponding to the tooth segment 4 on the protection cover, the tooth segment 5, unrotatable relative to the mounting base, is arranged on the end face of the moveable post facing the protection cover. The unlocking member 71 is composed of substance capable of being attracted by a magnet, such as iron, and is arranged on the outer end of the moveable post 7.

The outer end of the guide hole 61 is equipped with an end cover 72, a spring 73 is arranged between the moveable post 7 and the end cover 72. A keyway 62 and a notch 74 cooperating with each other can be arranged on the hole wall and the moveable post, so as to position the moveable post 7 and limit the movement of the moveable post 7.

The guide hole 61 and end cover 72 are dimensioned to allow the protector to be removed from a bottle using a standard magnetic EAS tag detacher as commonly provided in retail establishments for the removal of EAS tags (i.e. of the type comprising a cylindrical aperture having a magnet at the base thereof, thus no special tools or bespoke detachers are required for removal of the protector from a bottle.

In the normal state, by the action of the spring 73, the tooth segment 5 and the tooth segment 4 are retained in the meshed state. This the tooth segment 5 and the tooth segment 4 form a unidirectional tooth-lock fit. The protection cover or the mounting base can rotate along the direction of winding the tying tape. For example, when the protection cover is rotated with respect to the mounting base in the tightening direction, the tooth segment 4 slips on the tooth segment 5 tooth by tooth until the tying tape winds on the bottle surface tightly because for the tooth segment 4 is arranged on the protection cover and the tooth segment 5 is arranged on the moveable post unrotatable relative to the mounting base. Rotation of the protection cover and the mounting base in the opposite direction will be prevented.

To remove the protector from the bottle, the moveable post with the unlocking member 71 can be attracted by the unlocking tool with a magnet and forced to move towards the outer end of the hole 61. Then the tooth segment 5 and the tooth segment 4 can be released to allow the protection cover and the mounting base to rotate freely, thus detaching the bottle cap protector and permitting mounting of the protector onto another bottle.

The moveable post 7 can be composed of substance capable of being attracted by a magnet, in this way, the moveable post can be regarded as the unlocking member simultaneously, to say, the unlocking member is one part of the lock structure.

A fireproof cap or fireproof pad 75 can be arranged in the end cover to prevent the fit structure of the spring, end cover and moveable post from being destroyed by fire. The fireproof cap or fireproof pad 75 can lie between the spring and the end cover. Certainly, coating fireproof paint on the end cover can also achieve certain analogous effect.

The arrangement structure of the lock structure and the unlocking member is convenient for assembly. The assembly process comprises the following steps: connecting the tying tape with the mounting base and protection cover, sticking the mounting base on the lower surface of the protection cover, then covering the casing 6 on the protection cover and aligning the hold 61 with the tooth segment 4, then welding the casing and mounting base together by ultrasonic welding machine, then mounting the moveable post, spring, fireproof pad 75 and end cover into the hole.

The protection cover can be equipped with a step 11 cooperating with the casing 6, which is convenient for the axial position of the casing, the arrangement of the tooth segment 4 and the connection between the protection cover and the tying tape.

The tag 12 in the figures stands for the bayonet on the protection cover for connecting the tying tape, the tag 31 in the figures stands for the bayonet on the mounting base for connecting the rope, accordingly, the connecting ends 21 and 22 of the tying tape are chuck-shaped, this connecting mode is convenient for mounting, certainly, the connecting mode between the tying tape and the protection cover and the mounting base can be any structure and mode which can connect them well.

As shown in the figures, this embodiment employs two tying tapes, certainly, the tying tape can be one or three, four or more in practice.

The mounting base of the invention can only be explained as a single part, also be understood as a generalized concept, or it is a combined unit that is composed of a plurality of parts, for example, the combined unit that is composed of the casing 6 and the mounting base 3 in this embodiment, can rotate relative to the protection cover, and has a connecting position cooperating with the connecting end 22 of the tying tape.

The lock structure can employ multiple structures, for example, it can employ a spring plate with a lock end to fit the tooth segment unidirectionally, the spring plate can be arranged on the end face of the moveable post facing the protection cover, the tooth segment unrotatable relative to the protection cover can be arranged according to aforementioned structure. This structure will make it better to handle in operation. Certainly, the spring plate can be arranged on the protection cover and the tooth segment can be arranged on the moveable post, the spring plate and the tooth segment form a unidirectional tooth-lock fit.

The lock structure can employ the fit structure of a lock hole and a pin, for example, on the protection cover, along the rotating direction, the protection cover can be equipped with a lock hole, a pin unrotatable relative to the mounting base and cooperating with the lock hole.

In the preferred embodiments, the engaging and disengaging directions of the lock structure are radial, or the unlocking and locking directions are radial. As shown in the FIG. 2 and FIG. 3, the movement direction of the moveable post is radial.

In practice, by changing the arrangement position of the tooth segment and the spring plate, the unlocking and locking directions can be axial.

As shown in the FIGS. 1, 2, and 3, the lower end of the protector provided by the invention connects with a jacket or skirt 8. The jacket 8 connects with the lower end face of the mounting base 3 to strengthen the connection reliability of the protector and the bottle.

The protector provided by the invention is also equipped with an electronic article surveillance tag or label 9. It has been a difficult problem to arrange the label at low cost for a long time, according to former arrangement methods, if the label is cubic, it will be tied directly on the bottle surface, which is detrimental to the appearance of the goods, and the label subject to damage. If the label is plane-shaped, it will be adhered directly on the bottle surface.

In this embodiment, if the label is an element with defined volume, as shown in the FIG. 4, the sizes of the casing 6 and the mounting base 3 can be enlarged properly to form a cavity 91 for containing the label, the label can be arranged in the cavity and lie at the side surface of the protection cover. The mounting base 3 and the casing 6 become the protection casing to protect the outside of the label.

Thus the problem can be solved easily at low additional cost, and the goods appearance will be aesthetic and the label will be safe.

Similarly, for the plane shaped label, it can be arranged in the protection cover or space enclosed by the mounting base 3 and the casing 6.

The cap portion or protection cover 1 and the skirt or jacket 8 may be advantageously formed from a transparent material to allow the product branding and labeling to be seen through the protector when the protector is secured on a bottle.

Figure 5:
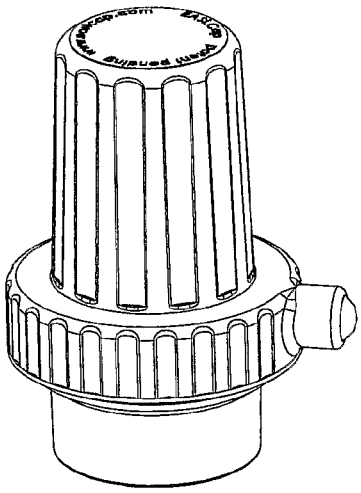
FIG. 5 is a schematic drawing of a second embodiment of the invention.
Figure 6:
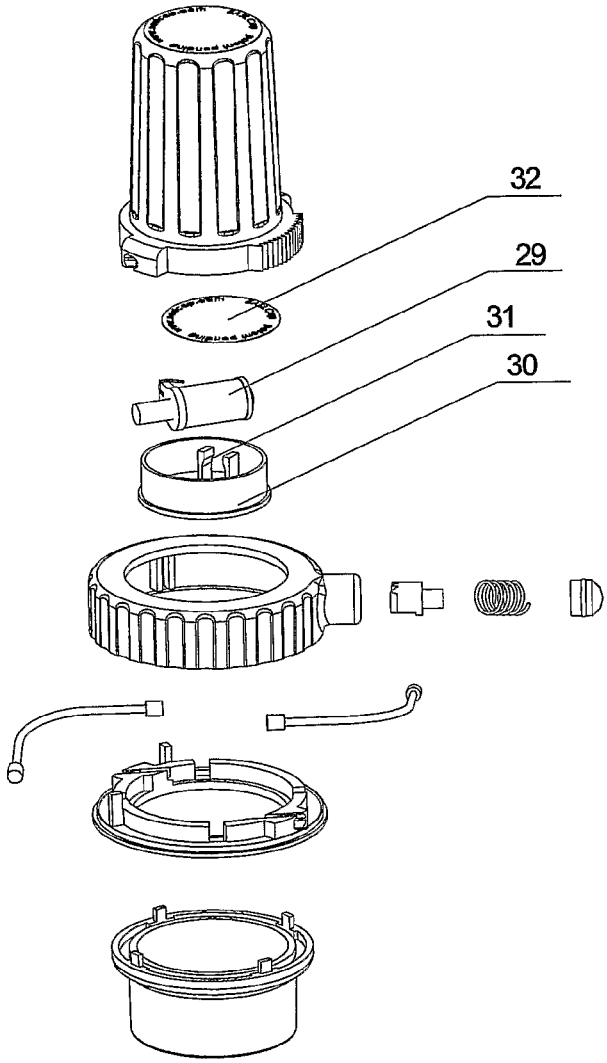
FIG. 6 is an exploded view of the FIG. 5.

Referring to the FIG. 5 and FIG. 6, in a second embodiment of the present invention, the electronic article surveillance label or tag is arranged inside the protection cover in an upper region thereof. The tag 31 is provided in a mounting base 20. The mounting base 30 can be covered by the aesthetic label paper 32. Others details of the second embodiment are the same as those of the first embodiment and thus need not be described in more detail.

The invention claimed is:

1. A device for protecting the cap of a bottle having a neck, said device comprising a cap portion adapted to be placed over the neck of the bottle and a base portion, the base portion being rotatably connected to the cap portion, at least one elongate securing member being provided having a first end attached to the cap portion and a second end attached to the base portion whereby rotation of the base portion with respect to the cap portion in a tightening direction causes the elongate securing member to tighten against the neck of the bottle to resist removal of the device from the neck of the bottle, locking means being provided for selectively preventing rotation of the base portion with respect to the cap portion at least in a second direction opposite to said tightening direction.

2. A device as claimed in claim 1, wherein the locking means comprises a locking member provided on the base portion and being moveable between a first position wherein the locking member cooperates with a region of the cap portion to prevent rotation of the cap portion with respect to the base portion and a second position wherein the cap portion is free to rotate with respect to the base portion to permit removal of the device from the neck of a bottle.

3. A device as claimed in claim 2, wherein biasing means are provided for biasing the locking member towards its first position.

4. A device as claimed in claim 2, wherein the locking member is moveable in a radial direction.

5. A device as claimed in claim 2, wherein the locking means comprises a toothed segment provided on the cover portion and the locking member comprises a pawl engageable with the toothed segment when the locking member is in said first position to prevent rotation between the cap portion and the base portion in at least said second direction.

6. A device as claimed in claim 5, wherein the teeth of the toothed segment and the cooperating portion of the locking member are shaped to permit rotation between the cap portion and the base portion in said tightening direction but to prevent rotation in said second direction when the locking member is in its first position in the manner of a ratchet.

7. A device as claimed in claim 2, wherein the locking member comprises a pin receivable in a receiving aperture provided on the cap portion when the locking member is in its first position.

8. A device as claimed in claim 2, wherein the locking member is magnetically moveable from its first to its second position when acted upon by an external magnetic field.

9. A device as claimed in claim 1, wherein a skirt portion extends from the base portion of the device to prevent tampering with the locking means when the device is fitted to a bottle.

10. A device as claimed in claim 1, including an electronic article surveillance tag.

* * * * *